US009702669B1

(12) United States Patent
Powell

(10) Patent No.: US 9,702,669 B1
(45) Date of Patent: Jul. 11, 2017

(54) SHAPED CHARGE

(75) Inventor: Kevin Mark Powell, Dunton Green (GB)

(73) Assignee: QINETIQ LIMITED, Farnborough (GB)

( * ) Notice: Subject to any disclaimer, the term of this patent is extended or adjusted under 35 U.S.C. 154(b) by 0 days.

(21) Appl. No.: 06/825,238

(22) Filed: Jan. 22, 1986

(30) Foreign Application Priority Data

Feb. 1, 1985 (GB) ..... 8502678

(51) Int. Cl.
*F42B 1/032* (2006.01)
*F42B 1/028* (2006.01)
*F42B 3/08* (2006.01)
*F42B 12/10* (2006.01)

(52) U.S. Cl.
CPC ..... *F42B 1/032* (2013.01); *F42B 1/028* (2013.01); *F42B 3/08* (2013.01); *F42B 12/10* (2013.01)

(58) Field of Classification Search
CPC .. F42B 1/02; F42B 1/028; F42B 1/032; F42B 3/08; F42B 12/10; F42B 12/16
USPC ..... 102/306–310, 476
See application file for complete search history.

(56) References Cited

U.S. PATENT DOCUMENTS 3,025,794 A * 3/1962 Lebourg ..... F42B 1/032 102/306
3,235,005 A * 2/1966 Delacour ..... 102/306 X
3,237,559 A * 3/1966 Auberlinder ..... 102/306 X
3,371,605 A 3/1968 Eckels ..... 102/24
3,437,036 A * 4/1969 Franzen et al. ..... 102/306 X
3,477,372 A 11/1969 McFerrin et al. ..... 102/24
3,561,361 A 2/1971 Kessenich et al. ..... 102/24
3,721,192 A * 3/1973 McEwan et al. ..... 102/306 X
3,865,036 A * 2/1975 Davis ..... 102/497
3,876,960 A * 4/1975 De Koker et al. ..... 102/306 X
3,877,383 A * 4/1975 Flatau ..... 102/503
3,976,010 A * 8/1976 Zernow ..... 102/476
4,041,866 A * 8/1977 Thevenin et al. ..... 102/306
4,074,630 A 2/1978 Zondag ..... 102/24
4,498,367 A * 2/1985 Skolnick ..... F42B 1/032 102/307

FOREIGN PATENT DOCUMENTS

DE 1136920 3/1960
DE EP 0157902 A2 * 10/1985 ..... F42B 12/105
GB 614320 A * 12/1948 ..... F41C 27/06
GB 839872 A * 6/1960 ..... C06C 15/00
GB 1469182 A * 3/1977 ..... C06B 33/08

OTHER PUBLICATIONS

James Ettrick, Ammunition and Weapon Design, Defence, pp. 567-570, Oct. 1982.*

* cited by examiner

*Primary Examiner* — James S Bergin
(74) *Attorney, Agent, or Firm* — Nixon & Vanderhye P.C.

(57) ABSTRACT

A shaped charge includes an explosive charge having a cavity lined with a laminate liner, the laminate liner comprising a primary liner located adjacent the cavity which forms a non-jet penetrator on detonation, and one or more supplementary liners each of which is less dense than the adjacent liner nearer the cavity. On detonation the liners form a series of penetrators, those formed by the supplementary liners acting to clear a path through an obstruction in front of a target to produce a more efficient attack on the target by that formed by the primary liner.

11 Claims, 2 Drawing Sheets

SHAPED CHARGE

Figure 1:
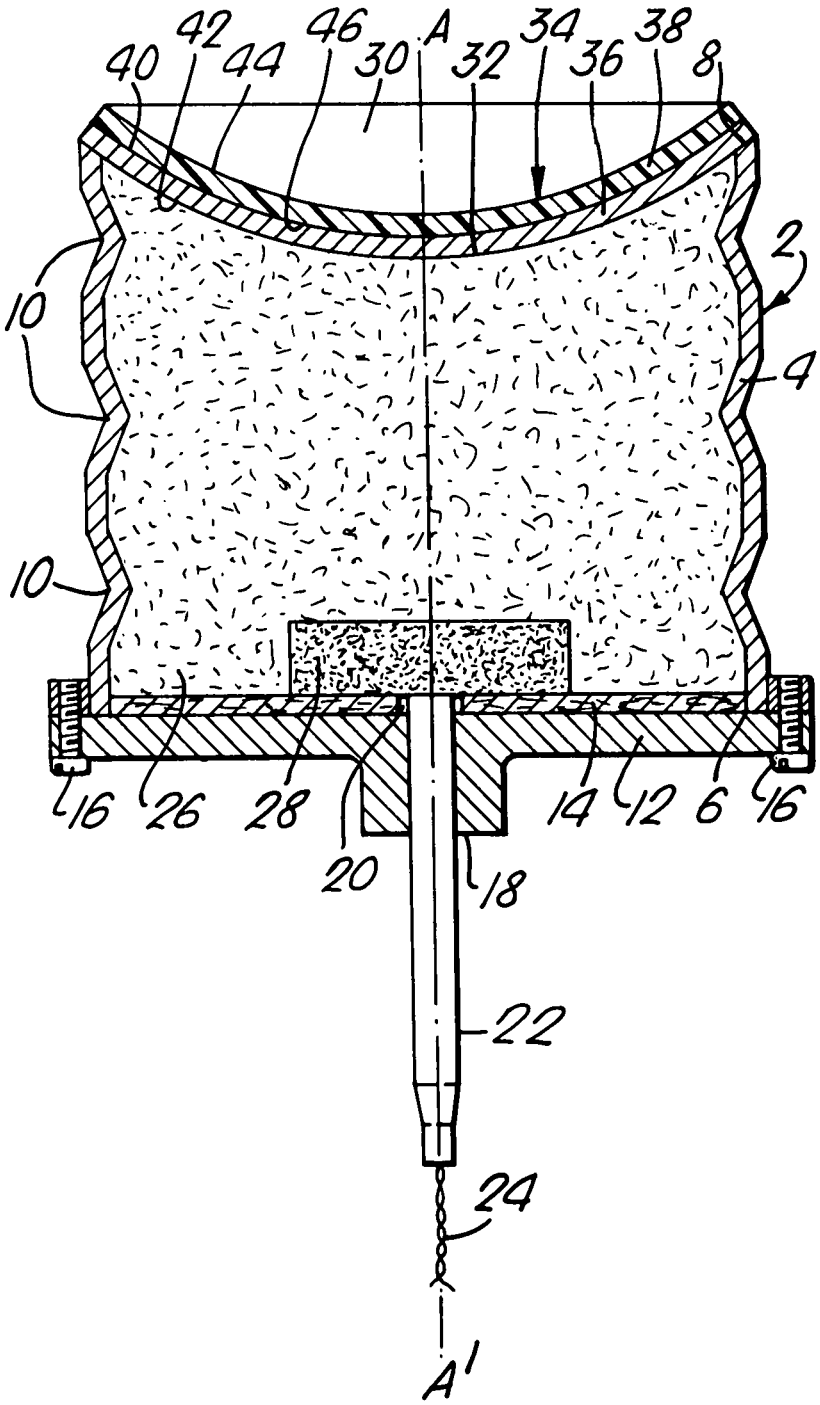

This invention relates to shaped charges.

It is well-known that the effectiveness of an explosive charge can be enhanced in a given direction by forming a symmetric hollow cavity, in the surface of the explosive and lining the cavity with a liner of a material such as metal. On detonation of the explosive charge the liner collapses and forms a high velocity penetrator which is ejected outwardly, the characteristics of which are principally determined by a the shape of the cavity, the liner material and the method of detonation of the charge. If the cavity is conical the liner generally forms a pencil-like jet moving at high speed along the axis of the cone: if the cavity is in the form of a V-shaped groove along the length of the explosive a planar jet is formed which can be used for linear cutting purposes. A shallow cavity on the other hand will tend to invert and compress the liner into a slower moving, self-forged fragment rather than a jet but it too moves outwardly from the cavity along its axis or plane of symmetry towards the target. However, if the liner is of a material which exhibits a low tensile strength in the conditions present at the time of penetrator formation a jet-like structure may be formed with a shallow cavity as there will be no restraint to stop those parts of the liner exposed to a greater acceleration, and which consequently acquire a higher initial velocity than other portions of the liner, from moving ahead of those other portions. On the other hand a shaped charge with a less shallow cavity may generate hydro-dynamic forces which tend to form a jet but if they are not sufficiently strong the tensile forces of the material will prevent any jet formation In this case a slug is formed which travels outwardly in the manner of a self-forged fragment. These penetrators may be classed as either jet or non-jet penetrators according to their form regardless of the formation processes during the explosion.

In each case the penetrating effectiveness of the ejected liner material against a target depends on having sufficient time for formation of the penetrator which occurs after it has travelled some distance from the cavity; any interference with this early formation process will reduce the effectiveness of the penetrator against the target.

There are many situations where an obstructing material will lie between the liner of such a shaped charge device and the target at the time the explosive charge is detonated, for example soil over-burden over a buried mine or over a target, water in a water filled outer casing surrounding a submarine pressure hull, or fuzes or sensors at the head of a guided weapon, any of which can interfere with the penetrator formation. It is an object of the present invention to provide a shaped explosive charge having improved penetration against a target situated behind such obstructing material.

Accordingly, the present invention provides a shaped charge including an explosive charge having a cavity lined with a laminate liner, the laminate liner comprising a primary liner located adjacent the cavity which on detonation of the explosive charge forms a non-jet penetrator, and one or more supplementary liners each of which is less dense than the adjacent liner nearer the cavity.

When a shaped charge according to the present invention is detonated the supplementary liners are accelerated out of the cavity at a greater rate than the primary liner. The liners therefore form independent penetrators, the supplementary liners exiting the cavity as a higher velocity, lower density penetrators and the primary liner following them as a lower velocity, higher density penetrator. The forward penetrators act to clear the obstructing material thereby allowing a more unimpeded attack of the target by the rearward penetrator formed from the primary liner. Because the primary liner forms a non-jet penetrator its formation is not impeded by the rearward elements of the forward penetrators. The primary liner of the laminate liner in the shaped charge according to the present invention absorbs less energy from the exploded charge than would a single liner of the same dimensions in an identical explosive device but its unimpeded formation into a penetrator results in a net gain in efficiency of penetrating the target behind obstructing material.

The laminate liner itself may be manufactured for use for later incorporation in a shaped explosive charge device or may be formed by bonding a suitable subsidiary liner on to the single liner of an existing lined shaped charge.

Figure 2:
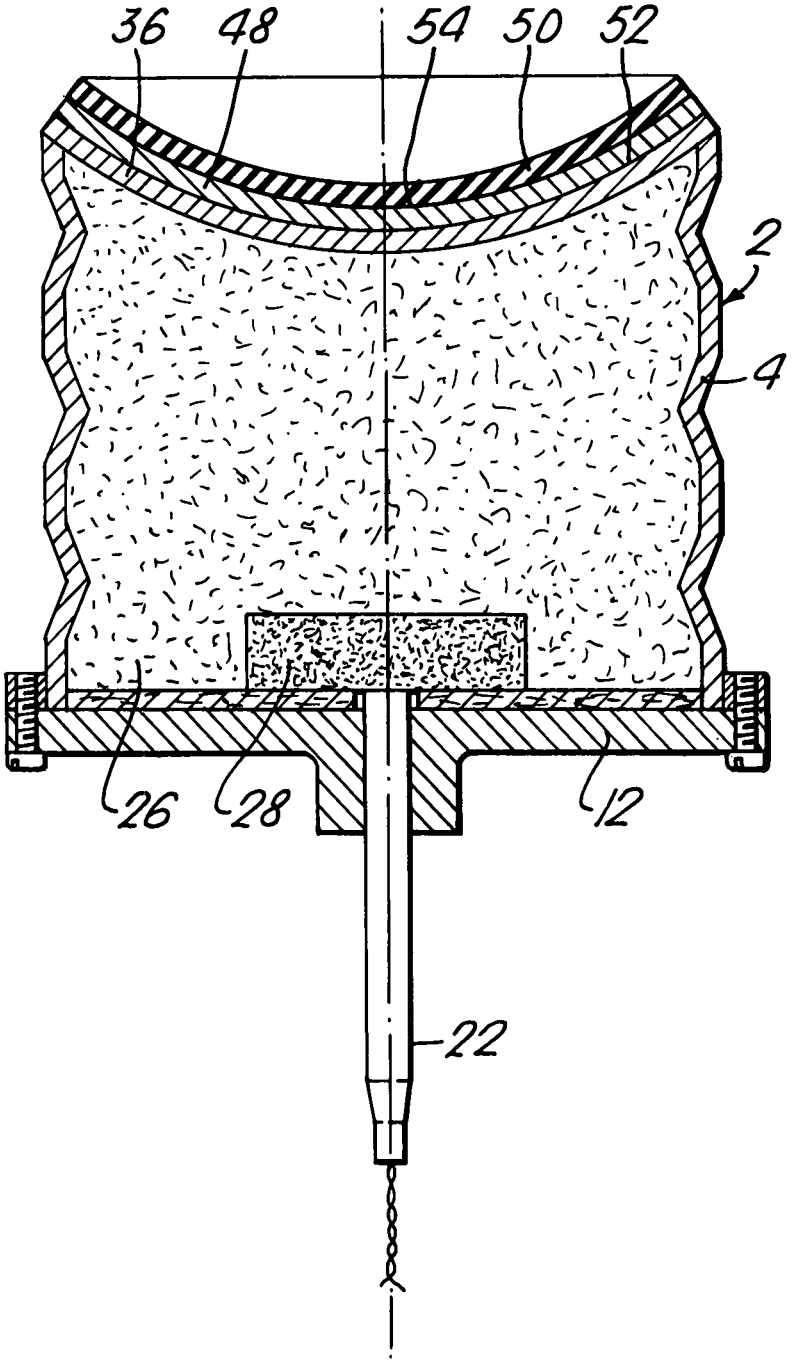

Embodiments of the invention will now be described, by way of example only, with reference to the accompanying drawing in which FIG. 1 shows an axial section of a land-mine having a laminate liner having one supplementary liner; and FIG. 2 shows an axial section of a land-mine having a laminate liner having two supplementary liners.

Referring to FIG. 1 there is illustrated a land mine 2 including a tubular steel casing 4 having a first end 6 and a second end 8. Shallow, conical indentations 10 are spaced circumferentially about the casing 4 in five staggered bands of which three are shown in FIG. 1. The casing 4 has an external diameter of 9.5 cm, a length of 7.5 cm and has a longitudinal axis AA's. The open end 6 is covered by a circular plate 12 and an annular felt washer 14 located on the casing 4 by four equidistantly spaced screws 16. Located at the centre of the plate 12 and the washer 14 are coaxially aligned openings 18 and 20, respectively, into which has been inserted an electrical detonator 22 of known design which can be detonated by connecting a source of electrical current (not shown) to electrical leads 24. Any standard detonator can be used in place of the electrical detonator 22 which is disclosed for illustrative purposes only.

Contained within the casing 4 is a main charge 26 of RDX/TNT: 60/40 within which is located a cylindrical booster charge 28 comprising a pellet of tetryl located adjacent the opening 20 and the detonator 22. Detonation of the detonator 22 by an electrical pulse will ignite the charge 28 which will in turn ignite the main charge 26.

Formed in the forward end of the charge 26 is a concave cavity 30 symmetrical about the longitudinal axis AA' of the casing 4 and the charge 26, and having a concave surface 32. Mounted within the cavity 30 contiguous with the surface 32 of the charge 26 is a laminate liner 34 comprising a primary liner 36 and a supplementary liner 38. The primary liner 36 is a mild steel Misnay Shardin plate having a density of 7.8 gm/cc which is 2.64 mm thick and has a 75 mm radius of curvature of spherical configuration having a forward face 40 and a rearward face 42 conforming to the surface 32 of the cavity 30. Mounted contiguous with the primary liner 36 on the opposite side from the explosive charge 26 is the supplementary liner 38 of 3 mm thick polyethylene of density 0.92 gm/cc having a forward face 44 and a rearward face 46 bonded to the forward surface 40 of the primary liner 36 by a contact adhesive.

The primary and supplementary liners 36 and 38 should be in intimate contact throughout adjacent surfaces 40 and 46 to ensure efficient energy transfer through the primary liner 36 to the supplementary liner 38 in order to produce well formed penetrators.

A method of manufacture for the laminated liner 34 illustrated in FIG. 1 comprises blow-moulding a polyethylene dish with a convex radius equal to the concave radius of the primary liner 36, spreading a thin film of contact adhesive onto the mating faces 40 and 46 and pressing them together with the aid of a hemispherical former (not shown) and holding it in place until a bond has formed. The bonding method used will vary with the materials constituting the primary and supplementary liners. A rubber-steel laminate liner can be formed, for example, by forming a vulcanised bond.

The operation of the land-mine disclosed in FIG. 1 is as follows. The detonator 22 is detonated which ignites in turn the booster charge 28 and the main explosive charge 26, the detonation wave starting at end 5 and progressing towards the laminate liner 34 at end 8. When the detonation wave strikes the laminate liner 34 its two component liners 36 and 38 are accelerated out of the cavity 30 at a rate approximately inversely proportional to their densities, the adhesive bond between the two being readily broken. The liners 36 and 38 then form into independent penetrators the supplementary liner travelling in front of the primary liner clearing a path through obstructing material to allow relatively free passage of the rearward penetrator to the target.

In the embodiment described the supplementary liner forms a jet penetrator travelling at approximately 4.5 mm/us and the primary liner a self-forging fragment travelling at approximately 2.5 m/us.

Referring now to FIG. 2 a land-mine with a Misnay Shardin plate primary liner 36 identical to that shown in FIG. 1 is provided with two supplementary liners 48 and 50 of aluminium and polyethelene respectively which on detonation produces three penetrators travelling towards a target. Again interfaces 52 and 54 between the liners should be in intimate contact.

The present invention is also of application to shaped charges in situations where there are no obstructions between the device and the target, particularly to multi-plate armoured targets. Against a target comprising spaced 6 mm armour plates the embodiment described with reference to FIG. 1 demonstrated a 25% enhancement of penetration performance over an identical mine not having the supplementary liner 38 of polyethylene bonded to the Misnay Shardin plate 36.

Other materials may be used for either of the liners in carrying out the present invention, for example a mild steel primary liner to which is laminated a supplementary liner of rubber, magnesium or aluminium of densities 1.25, 1.75 and 2.70 gm/cc, respectively. Experiments with either polyethylene or rubber, of Shore hardness 60, have a better performance than either the magnesium or aluminium supplementary liners.

One factor contributing to the better performance of polyethylene and rubber is that the high density ratio relative to the primary liner (>5:1) produces a forward penetrator travelling further in front of rearward penetrator than if smaller density ratios are used. This gives the forward penetrator more time to clear a path through the obstacles. The fact that rubber and polyethylene produce jet penetrators in this Misnay Shardin configuration further enhances the lead of the front of the forward penetrator from the front of the rearward penetrator.

The present invention is also applicable to generally conical and V-section linear liners but the tandem penetrator effect achieved decreases as the apex angle of the laminated liner decreases. Once the geometry is such that the primary liner produces a high velocity jet rather than a self-forging fragment or slug there is a tendency for the penetrator formed from the primary liner to impinge on the leading penetrator formed from the subsidiary liner thereby reducing the primary penetrator's performance. Experiments indicate that the laminated liner according to the present invention will be useful with conical and linear shaped charges against obscured targets if the apex angle is greater than 110°. The actual limit will of course depend on the liner materials used and the geometry of the particular shaped charge.

Experimentation on varying area density distributions of the supplementary liner indicates that a supplementary liner of uniform thickness provides the shaped charge device with a better penetration performance than one of non-uniform thickness.

The primary liner is not restricted to steel but may be any sufficiently dense material than will form a non-jet penetrator, in a given shaped charged, such as sintered tungsten alloy, depleted uranium and metal loaded plastics.

The invention claimed is:

1. A shaped charge comprising an explosive charge having a cavity in the surface thereof, and a laminate liner which lines the cavity, the laminate liner comprising a primary liner located adjacent the surface of the charge in the cavity, the material and shape of the primary liner being selected to form a non-jet penetrator on detonation of the charge, and one or more supplementary liners each of which is less dense than an adjacent liner nearer the surface of the charge in the cavity.

2. A shaped charge as claimed in claim 1 in which there is only one supplementary liner.

3. A shaped charge as claimed in claim 2 in which the ratio of the density of the primary liner to the density of the secondary liner is 3:1 or greater.

4. A shaped charge as claimed in claim 2 in which the ratio of the density of the primary liner to the density of the secondary liner is 5:1 or greater.

5. A shaped charge as claimed in claim 2 in which the primary liner is of steel and the supplementary liner is of polyethlene.

6. A shaped charge as claimed in claim 2 in which the primary liner is of steel and the supplementary liner is of rubber.

7. A shaped charge as claimed in claim 1 in which there are two supplementary liners.

8. A shaped charge as claimed in claim 1 in which the primary liner is a Misnay-Shardin plate.

9. A shaped charge according to claim 1 in which the cavity is in the form of a cone having an apex angle of greater than 110°.

10. A shaped charge according to claim 1 in which the cavity is in the form of a linear V-shaped groove having an apex angle of greater than 110°.

11. A shaped charge according to claim 1 in which the primary liner is of a material selected from the group consisting of mild steel, sintered tungsten alloy, depleted uranium and metal loaded plastic.

* * * * *